United States Patent [19]

Scheppman

[11] 3,987,448

[45] Oct. 19, 1976

[54] AM/FM ANTENNA SYSTEM

[75] Inventor: Ronald K. Scheppman, St. Ignace, Mich.

[73] Assignee: Lawrence Peska Associates, Inc., New York, N.Y. ; a part interest

[22] Filed: May 8, 1975

[21] Appl. No.: 575,545

[52] U.S. Cl. ..... 343/702; 343/788; 325/315; 325/317

[51] Int. Cl.[2] ..... H01Q 1/24

[58] Field of Search ..... 325/315, 370; 343/702, 343/726, 728, 788

[56] References Cited

UNITED STATES PATENTS 3,364,487 1/1968 Maheux ..... 343/702

FOREIGN PATENTS OR APPLICATIONS 1,021,438 12/1957 Germany ..... 325/370

*Primary Examiner*—Eli Lieberman

*Attorney, Agent, or Firm*—Jack D. Slobod

[57] ABSTRACT

An antenna system improvement for a conventional AM/FM radio having a ferrite coil antenna for AM and other antenna such as a telescoping whip for FM feeding an FM antenna input, includes a pair of terminals adapted to be connected to an external antenna lead in wire, an auxiliary coil wrapped around the ferrite antenna and a single pole double throw switch for connecting either the auxiliary coil or the FM antenna input to the terminals.

1 Claim, 2 Drawing Figures

AM/FM ANTENNA SYSTEM

FIELD OF THE INVENTION

The present invention relates generally to AM/FM radio receivers having both self contained AM and FM antennas and terminals for accepting an external antenna. In its particular aspects, the present invention relates to the provision of an auxiliary coil inductively coupled to the usual internal ferrite rod AM antenna and a switch for connecting the external terminals to either the coil or to the internal FM antenna.

BACKGROUND OF THE INVENTION

In the usual combined AM and FM radio receiver, a coil wrapped around a ferrite rod is utilized as an AM antenna and a separate antenna, such as a telescoping whip in the case of portables or a coupling to the line cord in the case of a table model, is utilized for FM. Frequently, it is desired to use such a radio receiver at a location quite distant from the broadcast station where the aforementioned internal antennas carried by the receiver produce inadequate reception. It is known to provide a pair of terminals coupled to the FM antenna input for accepting an external antenna. It is also known that the reception of an AM radio can be improved with an external antenna connected to a coil which is inductively coupled to the ferrite antenna. However, the problem has not been solved as to how to provide a single pair of external antenna terminals which are useable for both AM and FM bands.

It is an object of the present invention to provide in a conventional AM/FM radio receiver a system for coupling an external antenna for aiding both AM and FM reception.

It is a further object of the present invention to provide a simple and inexpensive means for coupling an external to a radio having the usual separate internal AM and FM antennas.

SUMMARY OF THE INVENTION

Briefly, the aforementioned and other objects of the present invention are satisfied by providing in a conventional combined AM and FM radio receiver an auxiliary coil wrapped around the ferrite AM antenna for inductively coupling thereto, and by further providing a pair of terminals for connection to an external antenna.

The auxiliary coil and the FM antenna input are connected to the terminals by switch means for coupling either the auxiliary coil or the FM antenna input to the terminals. Thus an antenna such as the type normally used for television, can selectively feed either the FM antenna input directly, or the AM antenna input via the auxiliary coil, ferrite antenna combination which serves as matching transformer in the AM band for the antenna and lead-in wire therefrom.

Other objects, features and advantages of the present invention will become apparent upon perusal of the following detailed description of the preferred embodiment thereof when taken in conjunction with the appended drawing wherein.

DETAILED DESCRIPTION

Figure 1:
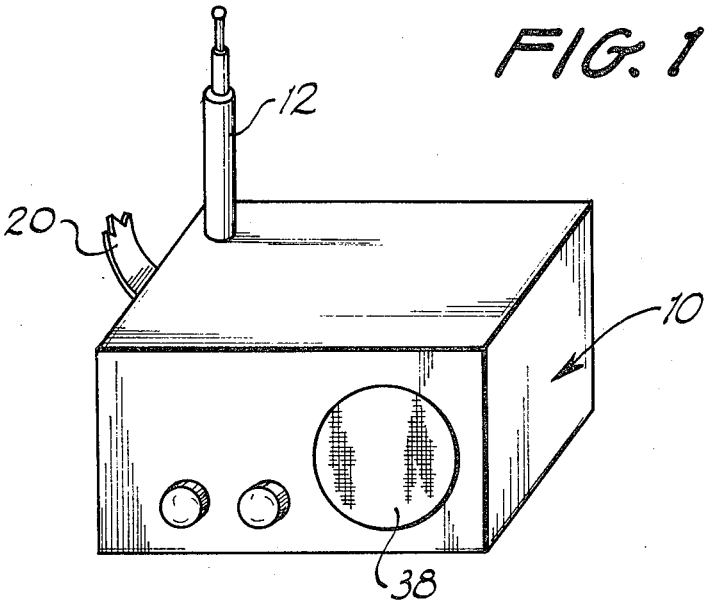
FIG. 1 is a pictorial presentation of the outside of a radio receiver in front elevation.
Figure 2:
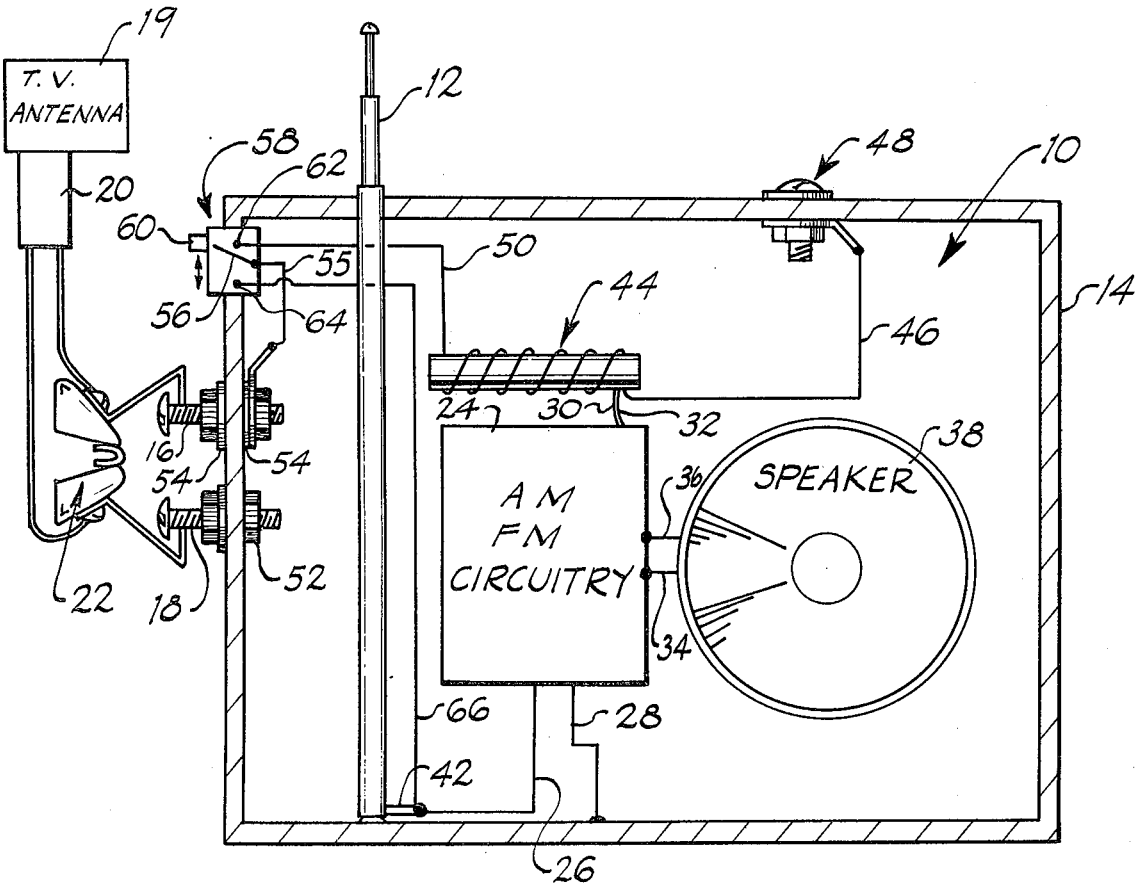
FIG. 2 is a schematical front elevation cross-section of the radio receiver of FIG. 1.

Referring to FIGS. 1 and 2, the teachings of the antenna system of the present invention are herein illustrated with respect to a portable combined AM and FM radio receiver 10 having a telescoping whip antenna 12 for the FM band. It should be understood that the present invention is equally applicable to other types of combined AM and FM receivers having other internal FM antenna means such as the provision of an antenna coupling to the line cord in a table model radio.

The present invention involves the provision, on the housing wall 14 for radio 10, of a pair of spaced apart studs or terminals 16 and 18 for connecting thereto an external antenna 19 such as the type used for television via the usual 300 ohm twin lead 20 and clothespin connector 22, in order to aid reception in both the AM and FM bands of radio 10.

The radio 10, which is somewhat schematically shown in FIG. 2 includes the usual AM and FM radio circuitry 24 having an FM antenna input port comprising leads 26 and 28, an AM antenna input port comprising leads 30 and 32, and an audio output port comprising the leads 34 and 36 which are connected to a speaker 38. The AM antenna input port is fed by the usual ferrite rod antenna 40 comprisng a coil (not shown) wrapped around a ferrite rod. To provide FM reception via telescoping antenna 12, lead 26 is connected to a terminal 42 at the base of antenna 12, while lead 28 is connected to the metal housing wall 14 to provide a ground plane for the antenna 12.

Now, as previously mentioned, the ferrite rod antenna 40 and the telescoping antenna 12 do not provide adequate AM and FM reception for distance stations. Accordingly, the T.V. antenna 19, having a high antenna is utilized to enhance reception in both bands via the external antenna terminals 16 and 18.

For coupling the T.V. antenna 19 to the AM antenna input port comprising leads 30 and 32, an auxiliary coil 44 is wrapped tightly around ferrite rod antenna 40 in close inductive coupling relationship to the coil. The number of turns in coil 44 is chosen to provide the ferrite antenna 40 and coil 44 as an impedance matching transformer for the impedance of antenna 19 in the AM frequency band.

One end of auxiliary coil 44 is grounded to the housing wall 14 via lead 46 connected from coil 44 to a bolt and nut combination 48 through wall 14. The other end of coil 44 is connected to lead 50. The leads 46 and 50 comprise an AM input port for external antenna 19.

Since leads 46 and 28 are grounded to housing wall 14, the stud 18 is also grounded to the wall by nuts 52 on opposite sides of the wall. For selectively directing the output of antenna 19 to either the AM external input port comprising leads 50 and 46 or the FM input port comprising leads 26 and 28 in order to avoid loading effects, the stud 16, which is insulated from the wall 14 by dielectric washers 54, is connected via lead 55 to the wiper 56 to a single pole double throw switch 58. Switch 58 is carried in the housing wall 14 and has an external slideable lever 60 for actuating wiper 56 into electrical contact with either contacts 62 or 64. Lead 50 is connected to contact 62 while terminal 42, at the base of antenna 12, is connected to contact 64 via lead 66.

In the use of the antenna system of the present invention, the internal AM antenna 40 and FM antenna 12 are always connected to circuitry 24 and thus always useable. However, when it is desired to improve reception, clothespin connector 22 is bridged across external terminals 16 and 18 and the lever 60 is set for coupling this external antenna input to either AM or FM receiving portions of the radio 10. It should be apparent that the present invention provides a technique for utilizing only one pair of external antenna terminals for aiding both AM and FM reception.

Having described in detail the preferred embodiment of the invention it should be apparent that numerous modifications, additions and omissions are possible thereto within the spirit and scope of the invention.

Accordingly,

What is claimed is:

1. In an AM/FM radio receiver within a housing having a ferrite coil antenna for AM and another distinct antenna means for FM coupled to an FM input the improvement comprising: a pair of terminals on said housing adapted to be connected to an external antenna, an auxiliary coil wrapped around said ferrite antenna in inductive coupling relationship thereto, and a single pole double throw switch having a wiper connected to one of said terminals and a pair of contacts, associated with said wiper, respectively connected to said auxiliary coil and to said FM antenna means for coupling either said auxiliary coil or said FM antenna means to said terminals.

* * * * *